US006273482B1

(12) United States Patent
Pickren

(10) Patent No.: US 6,273,482 B1
(45) **Date of Patent: *Aug. 14, 2001**

(54) POST HOLE DIGGER

(76) Inventor: Porter T. Pickren, P.O. Box 1511, Live Oak, FL (US) 32064

( * ) Notice: Subject to any disclaimer, the term of this patent is extended or adjusted under 35 U.S.C. 154(b) by 0 days.

This patent is subject to a terminal disclaimer.

(21) Appl. No.: 09/614,872

(22) Filed: Jul. 12, 2000

Related U.S. Application Data

(63) Continuation of application No. 09/411,922, filed on Oct. 4, 1999, now Pat. No. 6,089,632, which is a continuation of application No. 09/126,349, filed on Jul. 30, 1998, now abandoned.

(51) Int. Cl.[7] ..... A01B 1/00
(52) U.S. Cl. ..... 294/50.8; 294/57; 294/118
(58) Field of Search ..... 294/49, 50.6, 50.8, 294/50.7, 57, 118; 111/7.1, 92, 106

(56) References Cited

U.S. PATENT DOCUMENTS

| | | | |
|---|---|---|---|
| 171,942 | * | 1/1876 | Lee . |
| 208,703 | * | 10/1878 | Avery . |
| 715,260 | * | 12/1902 | Griffin . |
| 752,115 | * | 2/1904 | Smith . |
| 931,061 | * | 8/1909 | Hardy . |
| 1,706,332 | * | 3/1929 | Theriot . |
| 1,888,929 | * | 11/1932 | McDowell . |
| 2,028,680 | * | 1/1936 | Mayede et al. . |
| 2,192,399 | * | 3/1940 | Downes . |
| 2,230,498 | * | 2/1941 | Loos et al. . |
| 2,435,473 | * | 2/1948 | Sonnenberg . |
| 2,654,626 | * | 10/1953 | Rice . |
| 2,710,765 | * | 6/1955 | Arens . |
| 2,791,879 | * | 5/1957 | Truran . |
| 4,042,270 | * | 8/1977 | Weiland . |
| 5,273,331 | * | 12/1993 | Burnham . |
| 5,320,363 | * | 6/1994 | Burnham . |
| 5,427,424 | * | 6/1995 | Robinson . |
| 5,478,128 | * | 12/1995 | Aaland . |
| 5,669,648 | * | 9/1997 | Luck . |
| 5,727,828 | * | 3/1998 | Jones . |
| 5,743,579 | * | 4/1998 | Ranburger . |
| 5,820,183 | * | 10/1998 | Marcus . |
| 6,089,632 | * | 7/2000 | Pickren ..... 294/50.8 |

FOREIGN PATENT DOCUMENTS

| | | | |
|---|---|---|---|
| 1032172 | * | 6/1958 | (DE) ..... 294/50.6 |

* cited by examiner

*Primary Examiner*—Dean J. Kramer
(74) *Attorney, Agent, or Firm*—Saliwanchik, Lloyd & Saliwanchik

(57) ABSTRACT

The subject invention provides a post hole digger which facilitates the digging of deep uniform diameters post holes. The post hole digger accomplishes this by crossing the handles to close the shovel blades. This allows the handles to stay within the diameter of the hole opening, removing the need to increase the diameter of the hole opening as the depth of the hole is increased.

7 Claims, 4 Drawing Sheets

POST HOLE DIGGER

CROSS-REFERENCE TO A RELATED APPLICATION

This application is a continuation of patent application Ser. No. 09/411,922, filed Oct. 4, 1999 now U.S. Pat. No. 6,089,632; which is a continuation of patent application Ser. No. 09/126,349, filed Jul. 30, 1998, now abandoned.

BACKGROUND OF THE INVENTION

The present invention relates to a new and improved manual post hole digger. The improved manual post hole digger permits the user to more conveniently produce a vertical hole with an essentially constant hole diameter through the length of the hole, enabling the user to dig deep holes.

A common type of manual post hole digger is the clamshell post hole digger. Previously known clamshell post hole diggers typically comprise a pair of sharpened shovel blades mounted on pivotally connected elongated handles. The post hole digging is accomplished by thrusting the blades into the ground then spreading the handles apart forcing the shovel blades together gripping the soil. The soil is then removed from the hole and dumped to the side. This process is repeated until a hole of the desired depth is attained.

The principal problem with this type of clamshell post hole digger is, as the hole is dug deeper the handles cannot be spread sufficiently far apart to grip the soil. Therefore, the diameter at the hole opening must be increased as the depth of the hole is increased.

Many attempts have been made to design clamshell post hole diggers which can dig a deep hole without the need to increase the diameter at the opening of the hole. Such diggers are provided by: Luck (U.S. Pat. No. 5,669,648), Alienate (U.S. Pat. No. 5,478,128), Robinson (U.S. Pat. No. 5,427,424), Burnham (U.S. Pat. Nos. 5,320,363, 5,273,331), Arens (U.S. Pat. No. 2,710,765), Rice (U.S. Pat. No. 2,654,626), Sonnenberg (U.S. Pat. No. 2,435,473), Loos, et al. (U.S. Pat. No. 2,230,498), Mayeda, et al. (U.S. Pat No. 2,028,680), McDowell (U.S. Pat. No. 1,888,929) and Theriot (U.S. Pat. No. 1,706,332). These devices are complex and difficult to operate. The devices often contain numerous parts that become worn and damaged from the soil and debris.

There remains a need for a low cost, simply built, reliable, and easy to use clamshell post hole digger.

BRIEF SUMMARY OF THE INVENTION

One objective of the present invention is to provide an improved clamshell post hole digger that enables the user to dig essentially constant diameter holes. Advantageously, the present invention enables the user to use either abduction or adduction to dig deeper post holes without having to increase the diameter of the hole opening as the depth of the hole increases.

The post hole digger of the present invention utilizes a unique cross-handled design which enables the user to close the blades of the post hole digger without having the handles wider than the diameter of the top of the hole.

In a specific embodiment, the present invention comprises the following components, two sharpened shovel blades, two hinge brackets, and two elongated handles. Preferably, on the hinge brackets there are an offset handle mounting plate, shovel blade mounting plate, and an axial pivot point, where the offset handle mounting plate and the shovel blade mounting plate are on opposite sides of the axial pivot point. The elongated handles are secured to the offset mounting plates on the hinge brackets. The shovel blades are secured to the shovel blade mounting plate. The hinge brackets are secured together at the axial pivot point with the shovel blades opposing each other. In a preferred embodiment the shovel blades are made of stainless steel.

The offset configuration allows the elongated handles to be pushed or pulled towards each other and cross without coming into contact. Through this crossing the shovel blades close and the elongated handles stay within the diameter of the hole opening. This enables the user to dig a deeper constant diameter post hole.

A further objective of the present invention is to decrease the user's fatigue. The user can change from abduction to adduction and back to abduction by changing the position of the hands on the elongated handles. The switching from abduction to adduction allows the user to use different muscles and decrease fatigue.

A further aspect of the present invention pertains to markings on one, or both, of the elongated handles which show the depth of the hole. By having ruled handles, the user can easily dig a hole of a desired depth. Thus, one aspect of the present invention is a cross-handled post hole digger with ruled handles. The ruled handles of the present invention can also be used with a standard post hole digger.

Other objectives of the present invention are to provide a low cost, simply built, reliable, and easy to use clamshell post hole digger.

DETAILED DISCLOSURE OF THE INVENTION

The present invention pertains to an improved post hole digger which allows the user to dig deep, uniform diameter post holes without the need to widen the top of the hole. The post hole digger of the present invention utilizes a unique cross-handled design which enables the user to close the blades of the post hole digger without having the handles wider than the diameter of the top of the hole. In addition to allowing the user to dig uniform diameter holes, the unique cross-handled design of the post hole digger of the subject invention makes it possible for the user to use either adduction or abduction in operating the digger. Thus, the user is able to dig more (or deeper) holes without tiring.

Figure 1A:
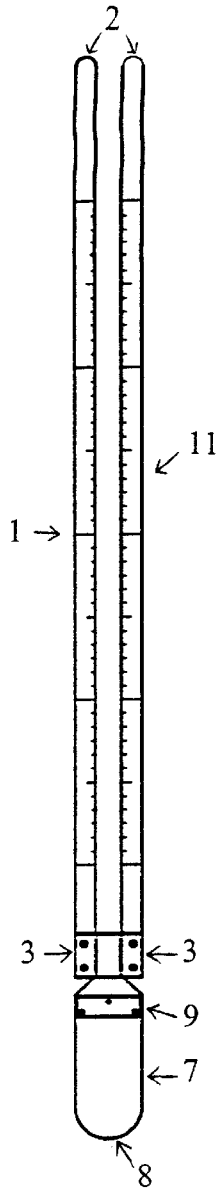
FIG. 1A depicts a full front view of a post hole digger of the present invention.
Figure 1B:
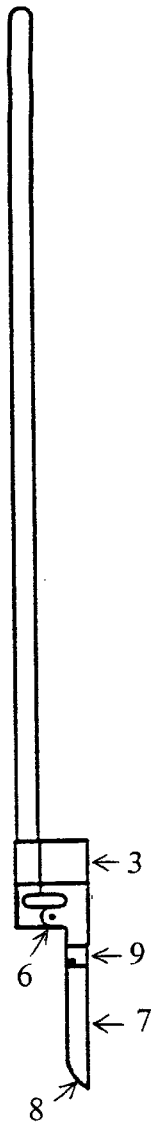
FIG. 1B depicts a partially disassembled post hole digger of the present invention, illustrating one-half of the full digger including one blade, one hinge bracket, and one elongated handle.
Figure 1C:
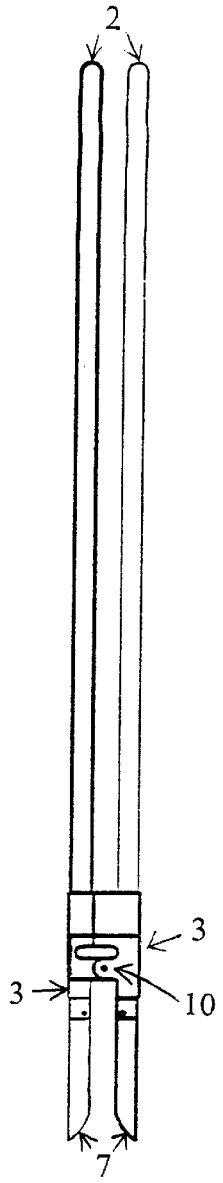
FIG. 1C depicts a full side view of a post hole digger of the present invention.
Figure 1D:
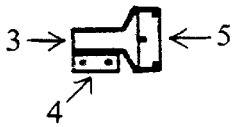
FIG. 1D depicts a side view of a hinge bracket of the subject invention, comprising an offset handle mounting plate and a shovel blade mounting plate.
Figure 1E:
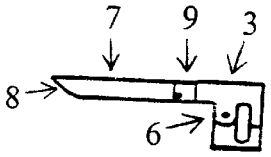
FIG. 1E depicts a side view of one blade assembly including a shovel blade and a hinge bracket.
Figure 1F:
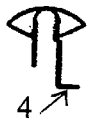
FIG. 1F depicts a front view of a hinge bracket which illustrates the offset handle mounting plate.
Figure 1G:
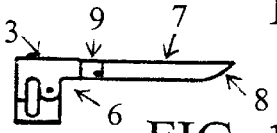
FIG. 1G depicts another side view of one blade assembly including a shovel blade and a hinge bracket.
Figure 2:
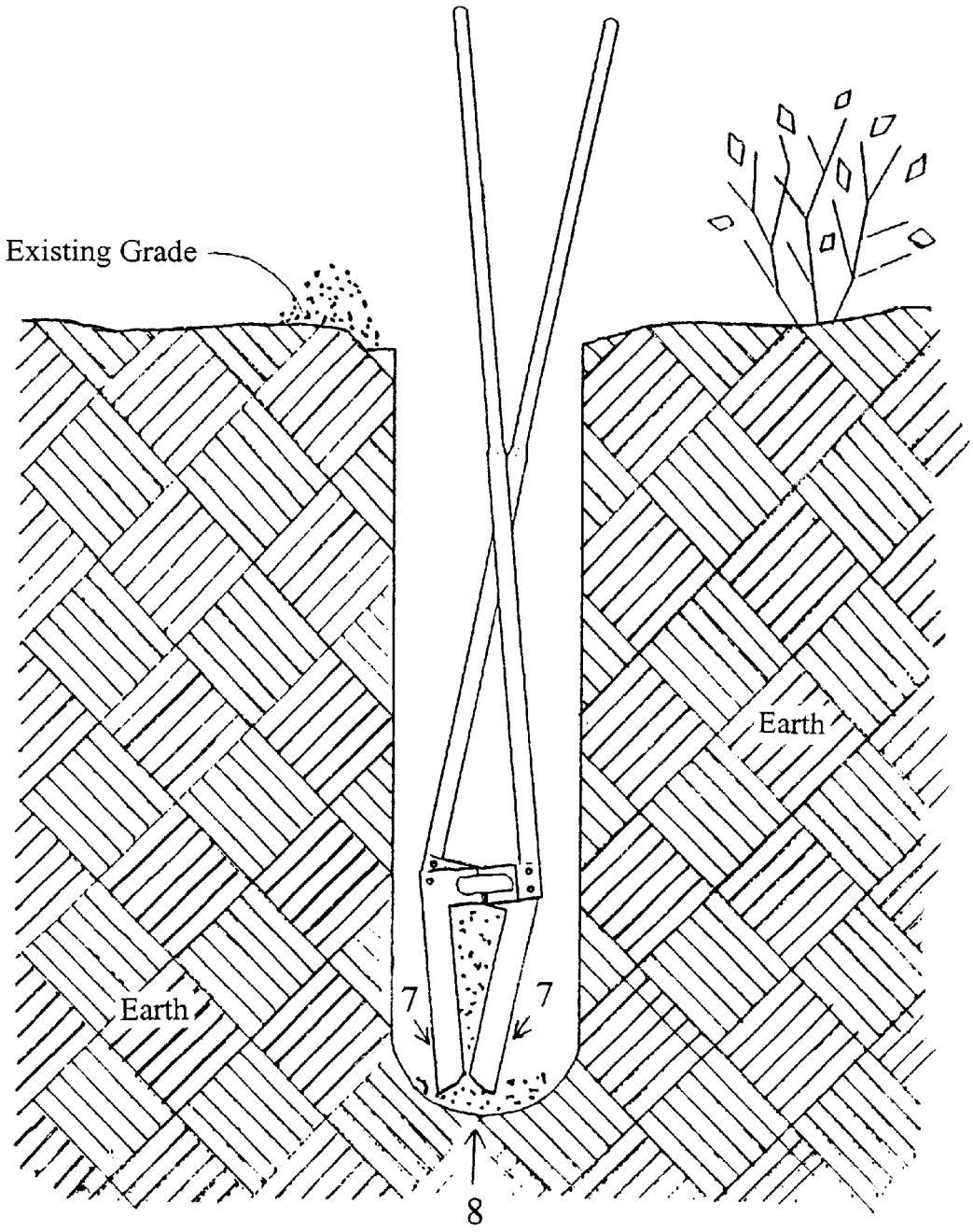
FIG. 2 depicts the elongated handles crossing, within the diameter of the hole, to close the shovel blades.
Figure 3:
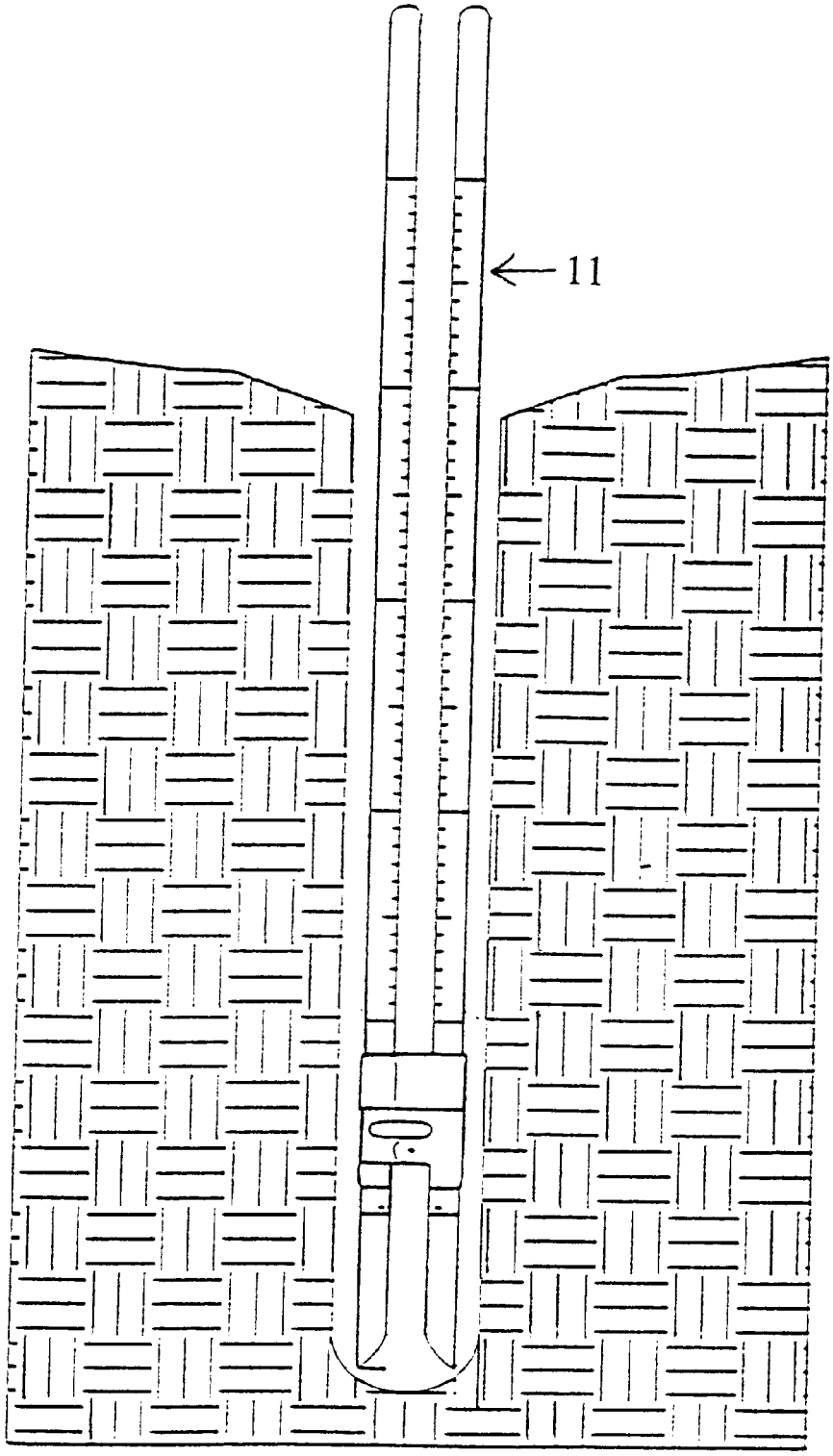
FIG. 3 depicts ruled elongated handles which indicate the depth of the hole.
Figure 4:
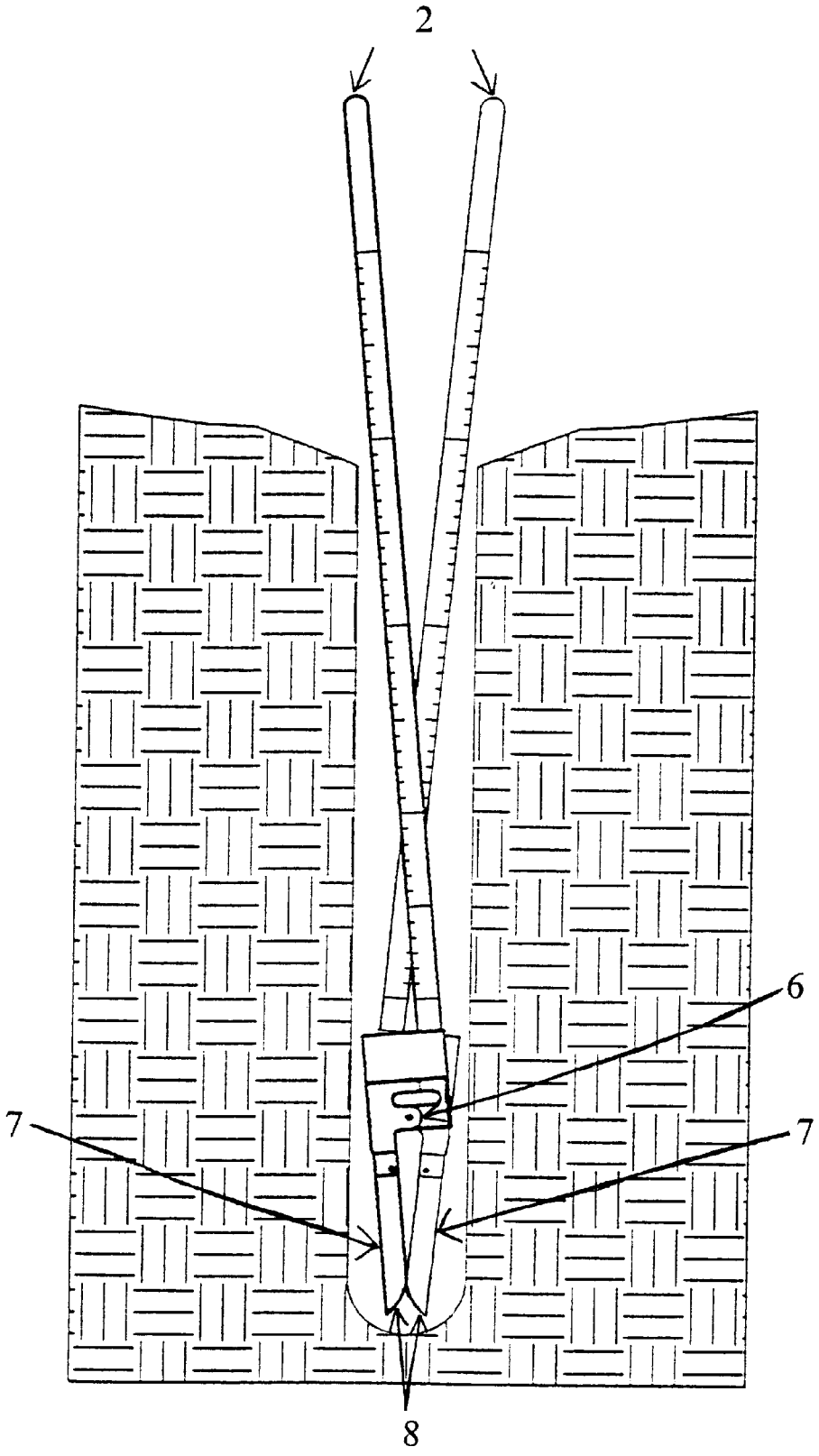
FIG. 4 depicts a full view of the post hole digger of the present invention.

A further aspect of the subject invention pertains to depth indicators on one or both of the handles of a post hole digger. These depth indicators are typically in the form of a ruled handles which show the depth of the hole in feet and inches, or in metric units or in other units. The present invention, which is best understood with reference to FIGS. 1A–1G, 2, and 3, will now be discussed in greater detail. The present invention as shown in FIGS. 1A–1G is a post hole digger 1. Referring to FIGS. 1 through 3, a preferred embodiment of the present invention comprises the following components: two elongated handles 2, two hinge brackets 3 each with a offset handle mounting plate 4, a shovel blade mounting plate 5, and a axial pivot point 6, where the offset handle mounting plate 4 and the shovel blade mounting plate 5 are on opposite sides of the axial pivot point 6, and two shovel blades 7 each with a sharpened end 8 and a shovel mounting member 9.

In a specific embodiment the elongated handle 2 is about 4 feet to 6 feet in length with a diameter of approximately ¾ inch to about 2 inches. Most preferably the handles are about 1 inch to 1.25 inches. The elongated handles 2 are mounted to the offset handle mounting plate 4 on the hinge brackets 3. The shovel blades 7 are mounted to the hinge brackets 3 by mounting the shovel mounting member 9 to the shovel blade mounting plate 5. The hinge brackets 3 are attached together by a pivot pin 10 at the axial pivot point 6 with the shovel blades 7 opposing each other. By moving the elongated handles 2 towards and away from each other, about the axial pivot point 6, causes the shovel blades 7 to close and open.

The precise location of the axial pivot point can be moved up or down to achieve the desired blade closing characteristics. A person skilled in the art, having the benefit of the instant disclosure would appreciate that by moving the pivot point away from the tips of the blades, it is possible to enhance the closure of the blades. This embodiment would be appropriate in, for example, sandy soil where full closure of the blades is desirable. On the other hand, a lower axial pivot point (closer to the tips of the blade) could be utilized in firm soils where complete closure of the blade tips is not critical. In one embodiment, the post hole digger is provided with multiple pivot point placements from which the user can choose the appropriate pivot point for a particular use. This can be accomplished by, for example, moving the pivot pin to one of the alternate axial pivot point placement locations.

To operate the post hole digger 1, the user grasps and holds the elongated handles 2 parallel to each other. The user then thrusts the sharpened ends 8 of the shovel blades 7 into the ground. As shown in FIG. 2, by moving the elongated handles 2 towards each other, crossing without coming into contact, about the axial pivot point 6 the shovel blades 7 close and grip the soil. The user lifts the post hole digger 1 out of the hole while maintaining pressure on the elongated handles 2. Once the post hole digger 1 has been removed from the hole, the user positions the clam shell post hole digger 1 and moves the elongated handles 2 away from each other, uncrossing, to open the shovel blades 7 and release the soil.

When moving the elongated handles 2 the user can change from abduction to adduction and back to abduction by changing the position of the hands. The switching from abduction to adduction allows the user to use different muscles and decrease fatigue. The cross-handled design of the present invention allows the user to close the blades to grasp soil using a motion wherein the user's arms and hands are in front of the body in a powerful position. This is in contrast to previous post hole diggers which required the user to extend his arms widely in order to grasp the soil. The user repeats this process until the hole has reached the desired depth.

In one embodiment one or both of the elongated handles 2 are ruled 11 to indicate the depth of the hole. This embodiment is shown in FIG. 3. The ruling may be in inches and/or metric. The ruling embodiment of the present invention can be used with a standard post hole digger in addition to the cross handled digger described herein.

In another embodiment the elongated handles 2 can have the ability to increase in length, to allow for the digging of deeper holes. The increase in the length of the elongated handles can be accomplished by different means including, but not limited, to the attaching of extensions to the elongated handles and designing the elongated handles with the ability to telescope, to increase and decrease in length.

The elongated handles 2 can be tapered having a larger diameter at the top and tapering to a smaller diameter at the base. The larger diameter at the top of the elongated handles 2 allows the user to better grip the elongated handles 2 and decrease fatigue. Alternatively, the handles may taper with the smaller diameter at the top. The top of the elongated handles 2 can be fitted with grips to allow the user to better grip the elongated handles 2.

The post hole digger 1 can be made out of any material that is suitable for outdoor use. In a preferred embodiment, the post hole digger of the present invention is made of a material which is durable, substantially non-corroding and light weight. Examples of such materials include, but are not limited to, aluminum, stainless steel, fiberglass, wood, and composite materials. Thus, the present invention post hole digger 1 is low cost, simply built, reliable, and easy to use. In a preferred embodiment, the blades of the post hole digger are made from high carbon steel. The material for connecting the blades to the handles may be, for example, CQMS milled steel.

The materials and dimensions for the preferred embodiments are typically as described herein. It should be understood and readily apparent that there exists a wide latitude in the exact dimensions of the present invention, and the physical dimensions can be readily altered to suit the need of the task. The foregoing is considered as illustrative only of the principles of the present invention. It would be apparent to those skilled in the art, having the benefit of the instant disclosure, that many changes and substitutions can be made to the preferred embodiment without departing from the spirit and scope of the present invention.

It should be understood that the examples and embodiments described herein are for illustrative purposes only and that various modifications or changes in light thereof will be suggested to persons skilled in the art and are to be included within the spirit and purview of this application and the scope of the appended claims.

What is claimed is:

1. A post hole digger comprising two shovel blades, wherein each blade has an elongated handle attached thereto, wherein each of said elongated handles has a proximal end where said handle is operably connected to said blade and a distal end where a user of said post hole digger grips said handle; wherein said handles are straight and extend parallel to each other when the blades are open; and wherein said blades are operably connected at an axial pivot point, with the shovel blades opposing each other such that the elongated handles are offset to allow the elongated handles to move towards each other and cross to close the shovel blades, such that the distal ends of said handles have crossed when the blades are closed.

2. The post hole digger, according to claim 1, wherein the elongated handles are ruled to indicate the depth of the hole.

3. The post hole digger, according to claim 1, wherein the elongated handles are tapered.

4. The post hole digger, according to claim 1, wherein the elongated handles are fitted with grips.

5. The post hole digger, according to claim 1, wherein the elongated handles have a means for allowing changes in the length of the elongated handles.

6. A method for digging post holes by utilizing a post hole digger comprising two shovel blades, wherein each blade has an elongated handle operably connected thereto, wherein each of said elongated handles has a proximal end where said handle is operably connected to said blade and a distal end where a user of said post hole digger grips said handle; wherein said handles are straight and extend parallel to each other when the blades are open; and wherein said blades are operably connected at an axial pivot point, with the shovel blades opposing each other such that the elongated handles are offset to allow the elongated handles to move towards each other and cross to close the shovel blades, such that the distal ends of said handles have crossed when the blades are closed, wherein said method comprises the steps of:

a) grasping and holding the elongated handles parallel to each other and thrusting the sharpened ends of the shovel blades into the ground, b) moving the elongated handles toward each other, eventually crossing without coming into contact, thereby closing the shovel blades and gripping the soil, and c) lifting the post hole digger out of the hole while maintaining pressure on the elongated handles, and uncrossing the elongated handles, to open the shovel blades and release the soil.

7. The method, according to claim 6, wherein said elongated handles are ruled to indicate the depth of the hole.

* * * * *